US007721807B2

(12) United States Patent
Stoisits et al.

(10) Patent No.: US 7,721,807 B2
(45) Date of Patent: May 25, 2010

(54) METHOD FOR MANAGING HYDRATES IN SUBSEA PRODUCTION LINE

(75) Inventors: Richard F. Stoisits, Kingwood, TX (US); David C. Lucas, The Woodlands, TX (US); Jon K. Sonka, The Woodlands, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 314 days.

(21) Appl. No.: 11/660,777

(22) PCT Filed: Aug. 11, 2005

(86) PCT No.: PCT/US2005/028485

§ 371 (c)(1),
(2), (4) Date: Feb. 21, 2007

(87) PCT Pub. No.: WO2006/031335

PCT Pub. Date: Mar. 23, 2006

(65) Prior Publication Data

US 2008/0093081 A1 Apr. 24, 2008

Related U.S. Application Data

(60) Provisional application No. 60/609,422, filed on Sep. 13, 2004.

(51) Int. Cl.
*E21B 43/01* (2006.01)

(52) U.S. Cl. ..... 166/366; 166/345; 166/367; 166/369; 166/268

(58) Field of Classification Search ..... 166/366, 166/345, 367, 369, 351; 134/8, 22.11
See application file for complete search history.

(56) References Cited

U.S. PATENT DOCUMENTS 4,735,267 A 4/1988 Stevens ..... 166/345

(Continued)

FOREIGN PATENT DOCUMENTS

WO WO 94/10492 A1 5/1994

(Continued)

OTHER PUBLICATIONS

EP Standard Search Report No. RS 112037 dated Feb. 2, 2005, 2 pages.

(Continued)

*Primary Examiner*—Thomas A Beach
*Assistant Examiner*—Matthew R Buck

(57) ABSTRACT

A method for managing hydrates in a subsea production system is provided. The system has at least one producing subsea well, a jumper for delivering produced fluids from the subsea well to a manifold, a production line for delivering produced fluids to a production gathering facility, and an umbilical for delivering chemicals to the manifold. The subsea well has been shut in, leaving produced fluids in a substantially uninhibited state. The method generally comprises the steps of pumping a displacement fluid into the chemical injection tubing, pumping the displacement fluid through a chemical injection tubing provided in the umbilical, further pumping the displacement fluid through the manifold and into the production line, and pumping the displacement fluid through the production line so as to displace the produced fluids before hydrate formation may begin. Preferably, a chemical inhibitor is placed in the chemical injection tubing before the displacement fluid is pumped into the chemical injection tubing.

31 Claims, 7 Drawing Sheets

U.S. PATENT DOCUMENTS

| | | | | |
|---|---|---|---|---|
| 6,139,644 | A * | 10/2000 | Lima | 134/8 |
| 6,475,294 | B2 | 11/2002 | McCanna et al. | |
| 6,536,461 | B2 * | 3/2003 | Decker et al. | 137/268 |
| 6,537,383 | B1 | 3/2003 | Mandke et al. | 134/8 |
| 6,596,089 | B2 * | 7/2003 | Smith et al. | 134/8 |
| 6,688,324 | B2 | 2/2004 | Hoang et al. | |
| 6,752,214 | B2 * | 6/2004 | Amin et al. | 166/369 |
| 6,772,840 | B2 * | 8/2004 | Headworth | 166/302 |
| 7,032,658 | B2 * | 4/2006 | Chitwood et al. | 166/61 |
| 7,093,661 | B2 * | 8/2006 | Olsen | 166/357 |
| 7,426,963 | B2 * | 9/2008 | O'Neill | 166/365 |
| 7,530,398 | B2 * | 5/2009 | Balkanyi et al. | 166/344 |
| 2004/0134662 | A1 | 7/2004 | Chitwood et al. | 166/367 |
| 2008/0053659 | A1 * | 3/2008 | Kinnari et al. | 166/367 |

FOREIGN PATENT DOCUMENTS

| | | |
|---|---|---|
| WO | WO 02/25060 | 3/2002 |
| WO | WO 03/095792 | 11/2003 |
| WO | WO 2004/033850 | 4/2004 |

OTHER PUBLICATIONS

PCT International Search and Written Opinion mailed Jan. 4, 2006, 7 pages.

Stoisits, R. F. et al., "Deep Water Single Production Line Tiebacks Achieving Operability Requirements While Minimizing Cost", 16$^{TH}$ Annual Deep Water Offshore Technology Conference, Nov. 30-Dec. 2, 2004, pp. 1-12, New Orleans, LA.

* cited by examiner

700

Impact of Displacement Circulation Rate on Water Removal From Flowline

800

900

1000

Flowline Water Volume Fraction Each Hour During Displacement at 8 KBPD

METHOD FOR MANAGING HYDRATES IN SUBSEA PRODUCTION LINE

CROSS REFERENCE TO RELATED APPLICATIONS

This application is the National Stage of International Application No. PCT/US2005/28485 filed 11 Aug. 2005, which claims the benefit of U.S. Provisional Patent Application No. 60/609,422 filed on Sep. 13, 2004.

BACKGROUND OF THE INVENTION

1. Field of the Invention

Embodiments of the present invention generally relate to subsea production systems. Embodiments of the present invention further pertain to methods for managing hydrate formation in subsea equipment such as production lines.

2. Description of the Related Art

Over the last thirty years, the search for oil and gas offshore has moved into progressively deeper waters. Wells are now commonly drilled at depths of several hundred feet and even several thousand feet below the surface of the ocean. In addition, wells are now being drilled in more remote offshore locations.

The drilling and maintenance of deep and remote offshore wells is expensive. In an effort to reduce drilling and maintenance expenses, remote offshore wells are oftentimes drilled in clusters. A grouping of wells in a clustered subsea arrangement is sometimes referred to as a "subsea well-site." A subsea well-site typically includes producing wells completed for production at one and oftentimes more pay zones. In addition, a well-site will oftentimes include one or more injection wells to aid in maintaining in-situ pressure for water drive and gas expansion drive reservoirs.

The grouping of subsea wells facilitates the gathering of production fluids into a local production manifold. Fluids from the clustered wells are delivered to the manifold through flowlines called "jumpers." From the manifold, production fluids may be delivered together to a gathering and separating facility through a production line, or "riser." For well-sites that are in deeper waters, the gathering facility is typically a floating production storage and offloading vessel, or "FPSO."

The clustering of wells also allows for multiple control lines and chemical treatment lines to be run from the ocean surface, downward to the clustered wells. These lines are commonly bundled into one or more "umbilicals." The umbilical terminates at an "umbilical termination assembly," or "UTA," at the ocean floor. A control line may carry hydraulic fluid used for controlling items of subsea equipment such as subsea distribution units ("SDU's"), manifolds and trees. Such control lines allow the actuation of valves, chokes, downhole safety valves and other subsea components from the surface. In addition, the umbilical may transmit chemical inhibitors to the ocean floor and then to equipment of the subsea processing system. The inhibitors are designed and provided in order to ensure that flow from the wells is not affected by the formation of solids in the flow stream such as hydrates, waxes and scale. Electrical lines may also be included in an umbilical for monitoring or control of subsea functions.

In cold water production environments, the management of hydrates in subsea equipment is important. Those of ordinary skill in the art will understand that hydrates may form along subsea wellheads and risers, restricting the flow of production fluids to the gathering facility. Hydrates are crystals consisting of water and gas molecules. The water molecules in produced fluid form a lattice structure into which many types of gas molecules may fit. Examples of such gas molecules include $H_2S$, $CO_2$ and $CH_4$. Hydrates that form as a result of $H_2S$, $CO_2$ and non-hydrocarbon gases are generically referred to as "gas hydrates." Hydrates that form as a result of natural gas (such as $CH_4$) in the production fluids may be more specifically referred to as "natural gas hydrates." Natural gas hydrates may form by water entrapping natural gases and associated liquids in a ratio of 85 mole % water to 15% hydrocarbons. Thus, when production fluids include water and gas molecules, and when such production fluids are at low temperatures and high pressures, the formation of hydrates in subsea equipment may restrict the flow of production fluids to a gathering facility.

In a production line, hydrate masses tend to form at the hydrocarbon-water interface. The hydrates may accumulate as fluid flow pushes the hydrate masses downstream. The hydrate mass can grow to a size that creates a "plug" or restriction to fluid flow. The resulting porous hydrate plugs have the unusual ability to transmit some degree of gas pressure, while acting as a liquid flow hindrance.

In order to manage hydrate formation, the operator may use jumpers and production lines that are insulated. In addition, the operator may inject chemical "inhibitors" at or near the subsea wellhead, such as into the manifold. Gas hydrates may be thermodynamically suppressed by adding materials such as salts or glycols, which operate as "antifreeze." Commonly, methanol or methyl ethylene glycol (MEG) may be injected at the subsea tree as the antifreeze material. Inhibitors are oftentimes introduced during well startup. The inhibitor will continue to be injected until the subsea equipment is sufficiently warmed by the produced fluids such that the risk of hydrate formation is abated. Inhibitors may also be introduced prior to a planned shut-in of a wellhead. In that instance, the injected methanol will commingle with the produced fluids before shut-in so that hydrate formation is avoided during the subsequent cooldown.

The management of hydrates becomes more difficult when production is shut in unplanned. In this instance, the operator may not have time to inject an inhibitor so as to "inhibit" produced fluids resident in the production line. This may occur, for example, where a gas compressor suddenly goes down. To prevent hydrate formation in the production line in this instance, it is known to provide a second alternate production line. A displacement fluid is injected into the second production line so as to circulate out the uninhibited produced fluids before hydrate formation occurs. Displacement is commonly accomplished by pushing a pig through the line. The pig is launched into the second production line and may be driven by a dehydrated crude out to the production manifold. The pig is then pumped through the production manifold and returned to the gathering facility through the first, or "live," production line. Displacement is completed before the uninhibited production fluids cool down below the hydrate formation temperature, thereby preventing the creation of a hydrate blockage in the line.

For relatively small offshore developments, the cost of a second production line can be prohibitive. Therefore, there is a need for an alternate method of displacing production fluids from a production line in order to manage hydrate formation.

SUMMARY OF THE INVENTION

A method for managing hydrates in a subsea production system is provided. The system has at least one producing subsea well, a jumper for delivering produced fluids from the subsea well to a manifold, a production line for delivering produced fluids to a production gathering facility, and an umbilical for delivering chemicals to the manifold. The producing well typically has at least some uninhibited produced fluids therein. The method includes the steps of shutting in the flow of produced fluids from the subsea well and through the production line; pumping a displacement fluid into the umbilical through a chemical injection tubing; pumping the displacement fluid through the chemical injection tubing, through the manifold, and into the production line; and pumping the displacement fluid through the production line so as to displace the produced fluids before hydrate formation begins.

The chemical injection tubing is preferably tied back to the gathering facility. Preferably, the umbilical defines a first umbilical portion that connects the gathering facility with an umbilical termination assembly, and a second umbilical portion that connects the umbilical termination assembly with the manifold. In one embodiment, the method further includes the step of pumping a chemical inhibitor into the chemical injection tubing before pumping the displacement fluid into the chemical injection line.

The gathering facility may be a floating production, storage and offloading vessel (FPSO), it may be a ship-shaped vessel, or it may be a facility located on shore or near shore.

In one aspect, the method employs a pig. The pig is placed in the chemical injection tubing ahead of the displacement fluid to aid in the displacing of produced fluids in the production line. In one embodiment, the pig is pumped through the chemical injection tubing, through the manifold, and through the production line using diesel.

A method for transporting hydrocarbons from an offshore production facility is also provided herein. In this method, the production facility receives produced hydrocarbons from one or more subsea wells, and from a production line associated with the one or more subsea wells. The subsea well and production line are associated with a subsea production system. The method generally comprises the steps of shutting in the flow of produced fluids from the subsea well and the production line; pumping a displacement fluid from the production facility into a chemical injection tubing, the chemical injection tubing being within an umbilical; further pumping the displacement fluid into the chemical injection tubing so that displacement fluid is urged through a subsea manifold and into the production line; further pumping the displacement fluid through the production line so as to displace the produced fluids before hydrate formation begins; re-initiating the flow of produced fluids from the subsea wells and through the production line to the production facility; and transporting the produced fluids from the offshore production facility.

In one aspect, the step of transporting the produced fluids from the offshore production facility comprises offloading the produced fluids from the offshore production facility onto a tanker; and transporting the produced fluids to an onshore terminal.

The subsea production system further comprises a jumper for delivering produced fluids from the subsea well to a manifold, and a valve for selectively placing the chemical injection tubing in fluid communication with the manifold. The umbilical further comprises a first umbilical portion that connects the gathering facility with an umbilical termination assembly, and a second umbilical portion that connects the umbilical termination assembly with the manifold. The production line comprises a production riser in fluid communication with the production facility, and a flowline for placing the manifold in fluid communication with the production riser.

BRIEF DESCRIPTION OF THE DRAWINGS

As an aid in understanding certain embodiments of the inventions herein, drawings, tables and charts are provided. Appended drawings include:

FIG. 6 again presents the production line and umbilical of FIG. 3. Here, a chemical inhibitor has been pumped into the umbilical for future use in the event of an unplanned production shut-in.

DETAILED DESCRIPTION

Definitions

Figure 1:
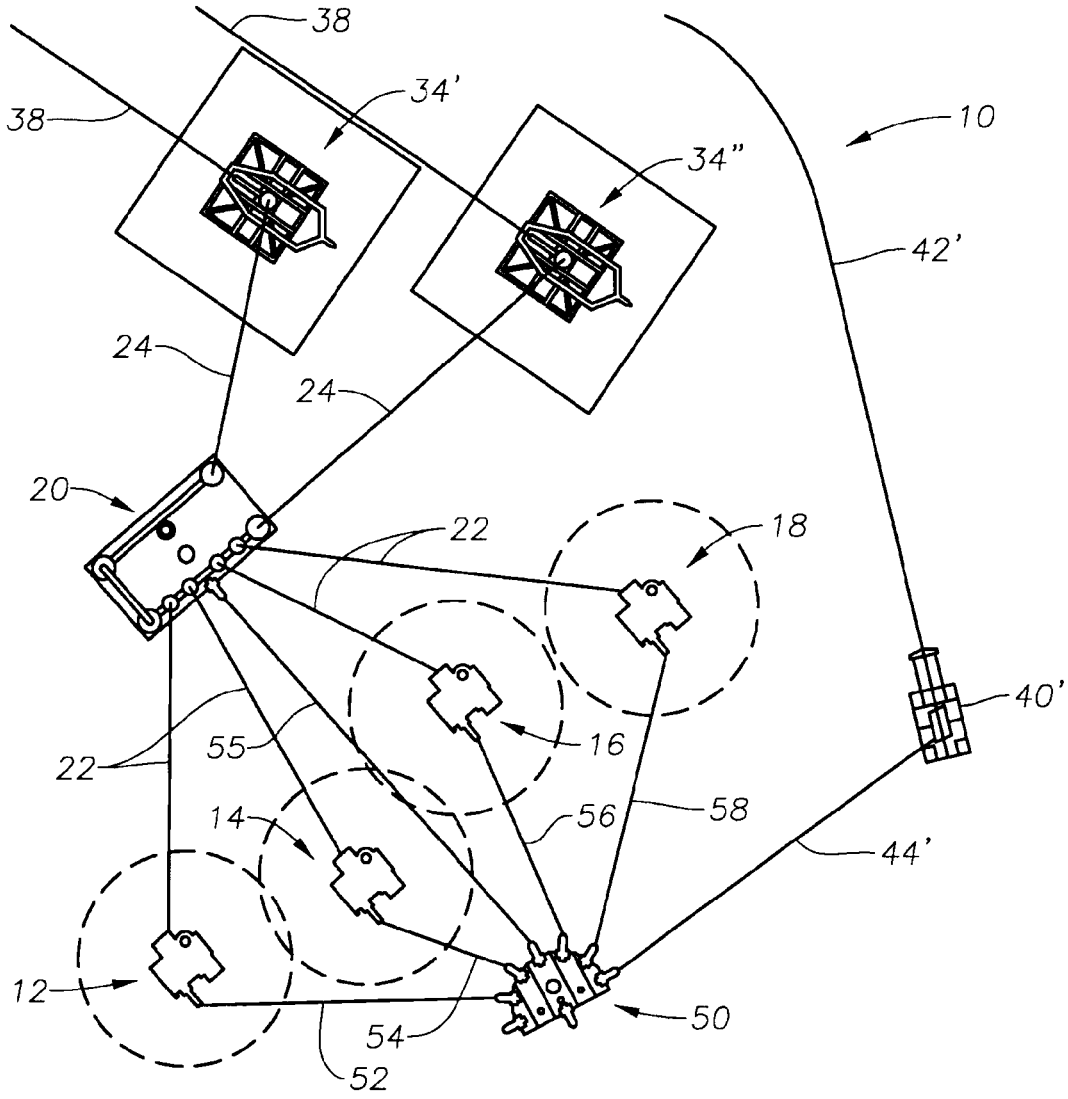
FIG. 1 is a plan view of a subsea cluster production system, or well site. The illustrative cluster production system includes multiple producing wells, with flowline jumpers delivering produced fluids into a manifold. An umbilical deliver(s) fluids such as hydraulic control fluids or chemical inhibitors to the individual wells through a central distribution unit.

The following words and phrases are specifically defined for purposes of the descriptions and claims herein. To the extent that a term has not been defined, it should be given its broadest definition that persons in the pertinent art have given that term as reflected in printed publications, dictionaries or issued patents.

"Gathering facility" means any facility for receiving produced hydrocarbons. The gathering facility may be a ship-shaped vessel located over a subsea well site, an FPSO vessel located over or near a subsea well site, a near-shore separation facility, or an onshore separation facility.

The terms "tieback," "tieback line," "riser" and "production line" are used interchangeably herein, and are intended to be synonymous. These terms mean any tubular structure for transporting produced hydrocarbons to a gathering facility. "Tied back" means to place a line (such as a production line or umbilical) in fluid communication.

"Subsea production system" means an assembly of production equipment placed in a marine body. The marine body may be an ocean environment, or it may be, for example, a fresh water lake. Similarly, "subsea" includes both an ocean body and a deepwater lake.

"Subsea equipment" means any item of equipment placed proximate the bottom of a marine body as part of a subsea production system.

"Subsea well" means a well that has a tree proximate the marine body bottom, such as an ocean bottom. "Subsea tree," in turn, means any collection of valves disposed over a wellhead in a water body.

"Umbilical termination assembly" means any item of subsea equipment that provides a termination point for one or more umbilical lines. The umbilical termination assembly, or "UTA," may be placed on an ocean bottom, a mud mat, a manifold, a suction pile, or any other position proximate to the sea floor.

"Subsea distribution unit" means any item of subsea equipment that provides at least hydraulic and/or chemical distribution in a subsea production system. "Subsea distribution unit" may be abbreviated as "SDU."

"Manifold" means any item of subsea equipment that gathers produced fluids from one or more subsea trees, and delivers those fluids to a production line, either directly or through a jumper line.

"Pig" means any device used to provide a fluid barrier between two different types of fluids within a flow line. The term may include a mechanical fluid displacement device, or it may include another fluid, such as an expandable foam plug or a gel.

"Jumper" means any flowline for connecting items of subsea equipment.

"Inhibited" means that produced fluids have been mixed with or otherwise been exposed to a chemical inhibitor for inhibiting formation of gas hydrates including natural gas hydrates. "Uninhibited" means that produced fluids have not been mixed with or otherwise been exposed to a chemical inhibitor for inhibiting formation of gas hydrates.

DESCRIPTION OF SPECIFIC EMBODIMENTS

The following provides a description of certain specific embodiments of the present invention:

FIG. 1 presents a plan view of a subsea cluster production system, or well site 10. The illustrative subsea well-site 10 includes four wells 12, 14, 16, 18. The illustrated wells 12, 14, 16, 18 represent producing wells. Flow lines, or "tree jumpers," 22 deliver produced fluids from the individual wells 12, 14, 16, 18 to a manifold 20. The manifold 20 collects the produced fluids from the individual wells 12, 14, 16, 18. In one arrangement, production collected from jumpers 22 may be commingled, and then delivered to a first production sled 34'. Production is delivered to the sled 34' via jumper 24. From the sled 34', produced fluids are transported up to a gathering facility (not shown in FIG. 1) through a production line 38.

In the arrangement shown in FIG. 1, production is commingled and delivered from the manifold 20 to the first production sled 34'. A second production sled 34" is provided that is also connected to the manifold 20 by a jumper 24. The second production sled 34" also has a production line 38 connected to a gathering facility. The second sled 34" is used to produce fluid from the wells, and is used when production in the subsea wells 12, 14, 16, 18 is shut-in unexpectedly. The second sled 34" then receives a displacing fluid which is circulated through the manifold 20 and into the primary sled 34' and the connected production line 38.

It is desirable for the operator of the subsea production system 10 to be able to remotely control valves at the manifold 20. It is also desirable that the operator be able to monitor subsea conditions such as fluid temperature within the manifold 20. Those of ordinary skill in the art will understand that manifold and sled designs vary in sophistication and complexity, and may include complex control and distribution systems, sometimes known as "control pods" or subsea control modules (SCM). Control pods are modules that contain electro-hydraulic controls, logic software, and communication signal devices. A master computer in a host platform control room (not shown) communicates with the subsea control pods to operate the valves and other functions on the manifold to increase or reduce flow rates, or to shut in the flow entirely, if needed.

It is desirable that the operator also be able to inject chemicals into the manifold and the individual wellheads to maintain flow assurance. As noted above, water present in the produced fluids can form natural gas hydrates. In addition, at low temperatures the waxy paraffins in some crude oils deposit on pipeline walls, constricting flows. To overcome these conditions, the operator may inject paraffin inhibitors to keep paraffins and waxes from solidifying or depositing in the flow streams. In addition, the operator may inject methanol or glycol to serve as a form of "antifreeze," preventing hydrates from forming. Further, the operator may inject scale inhibitors and corrosion inhibitors through flowline jumpers and subsea equipment.

FIG. 1 shows line 42' delivered from the host platform or other source to an umbilical termination assembly ("UTA") 40'. Line 42' represents an integrated electrical/hydraulic umbilical. Line 42' provides conductive wires for providing power to subsea equipment, and also provides hydraulic fluid needed to power subsea functions. Finally, line 42' provides chemicals to be distributed through the system 10. The various sublines within line 42' are typically bundled together, such as in a thermoplastic sheath. Line 42' terminates at the umbilical termination assembly 40'. From the umbilical termination assembly 40', umbilical line 44' is provided, and connects to a subsea distribution unit ("SDU") 50. Line 44' may be a flying lead line for delivery of fluids and signals from line 42'. From the SDU 50, flying leads 52, 54, 56, 58 connect to the individual wells 12, 14, 16, 18, respectively. In addition, flying lead 55 may be installed to connect to the manifold 20 so as to deliver chemicals and to provide power or control to the manifold 20, as desired by the operator.

The subsea cluster 10 of FIG. 1 represents a relatively complex and expensive production system. For smaller developments or fields, the cost of a second sled 34" and production line can be prohibitive. At the same time, the need remains to displace produced fluids from the primary sled 34' and production line 38 in the event production is shut in so as to prevent the formation of hydrates in the line 38. Accordingly, methods are provided herein for displacing fluids through a production line 38 without pumping a displacing fluid through a second production line.

Figure 2:
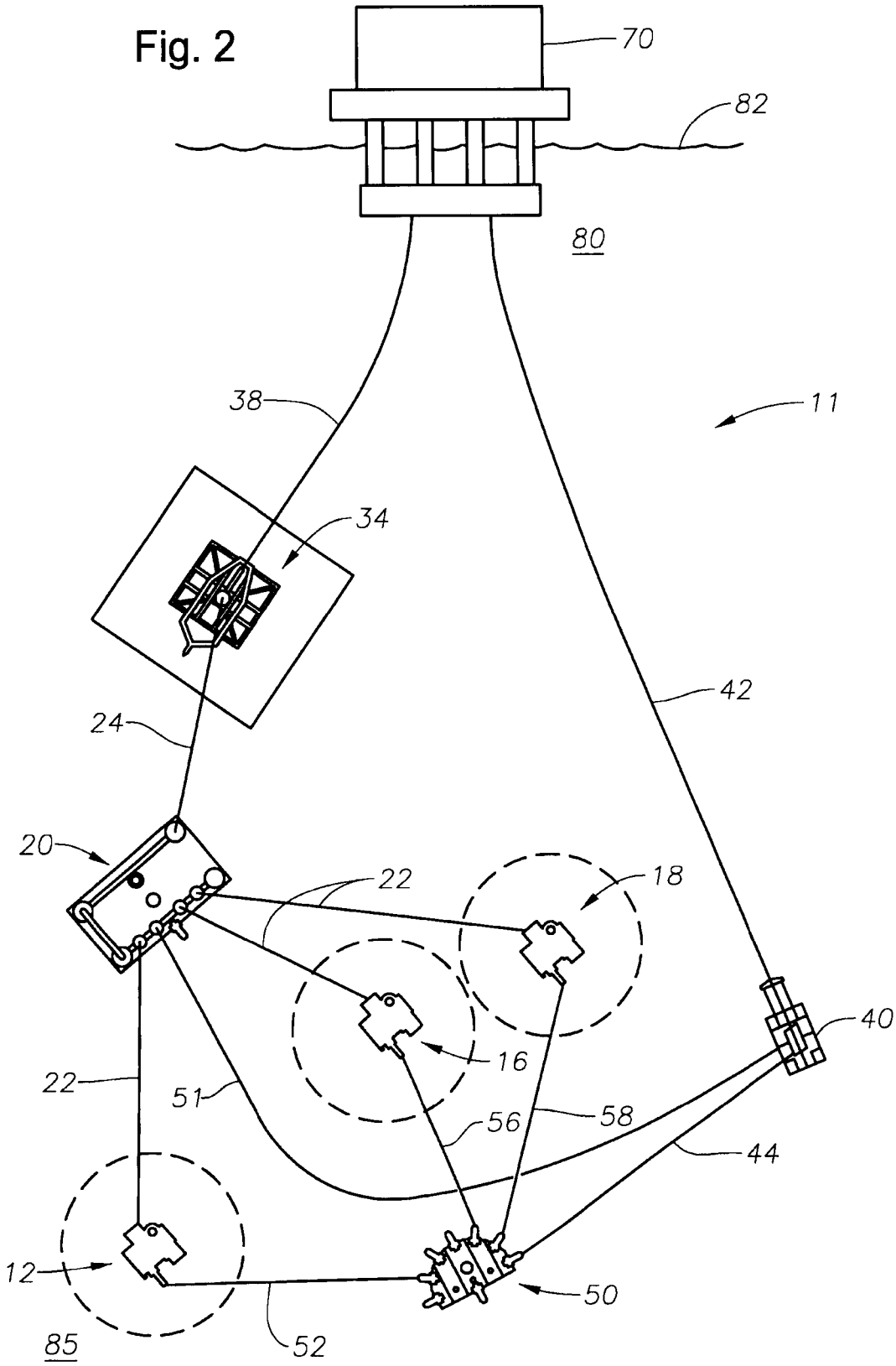
FIG. 2 provides a plan view of a more modest subsea cluster production system. A production gathering system is shown at an ocean surface. A single production line connects the manifold of the subsea production system to the gathering facility.

FIG. 2 provides a plan view of a more modest subsea cluster production system 11 which may be used to produce from a smaller field. In this view, three wells 12, 16 and 18 are shown. The wells 12, 16, 18 have subsea trees on a marine floor 85. One of the wells, e.g., well 16, may be a water injection well. Jumper lines 22 are again shown delivering produced fluids from the wells 12, 16 18 to a manifold 20. The second production sled (34" from FIG. 1) has been eliminated. Produced fluids are commingled at the manifold 20, and exported from the well-site through a single production line 38.

It can be seen in FIG. 2 that the production line 38 ties back to the gathering facility. An FPSO is illustrated at 70 as the gathering facility. However, it is understood that the gathering facility may alternatively be a ship-shaped vessel capable of self-propulsion. The gathering facility 70 is shown positioned in a marine body 80, such as an ocean. The marine body has a surface 82 and a bottom 85.

A utility umbilical 42 is again used. Line 42 represents an integrated electrical/hydraulic umbilical. Line 42 provides conductive wires for providing power to subsea equipment, and also provides hydraulic fluid needed to power subsea functions. Line 42 also provides chemicals to be distributed through the system 11. Preferably, the line 42 is tied back to the host platform or gathering facility. The umbilical 42 again connects to an umbilical termination assembly ("UTA") 40. From the umbilical termination assembly 40, line 44 is provided, and connects to a subsea distribution unit ("SDU") 50. From the SDU 50, flying leads 52, 56, 58 connect to the individual wells 12, 16, 18, respectively.

In addition to these lines, which are common with the architecture of FIG. 1, a separate umbilical line 51 is directed from the UTA 40 directly to the manifold 20. A chemical injection tubing (not seen in FIG. 2) is placed in both of service umbilical lines 42 and 51. The chemical injection tubing is sized for the pumping of a fluid inhibitor followed by a displacement fluid. The displacing fluid is pumped through the chemical tubing, through the manifold 20, and into the production line 38 in order to displace produced fluids from the production line 38 before hydrate formation begins. The chemical inhibitor may be injected through the same chemical injection tubing prior to pumping of the displacement fluid to partially displace and at least partially inhibit the uninhibited produced fluids in the single production line 38.

The displacing fluid may be dehydrated and degassed crude oil. Alternatively, the displacing fluid may be diesel. In either instance, it is preferred that the injection of the displacement fluid into the chemical tubing be preceded by the chemical inhibitor to serve as an inhibitor "pill." The "pill" may be methanol, glycol, MEG or other inhibitor fluid. Preferably, the inhibitor fluid is retained within the chemical injection tubing during times of production. In this aspect, the inhibitor fluid would be held in reserve pending an unexpected production shut-in. A valve (shown at 37 in FIG. 3) may be placed in-line between the chemical tubing and the manifold 20 to provide selective fluid communication with the production line 38.

It is understood that the architecture of system 11 shown in FIG. 2 is illustrative, and that other arrangements may be employed for practicing the methods disclosed herein. For example, the gathering facility 70 may be a separation facility on land or near shore.

Figure 3:
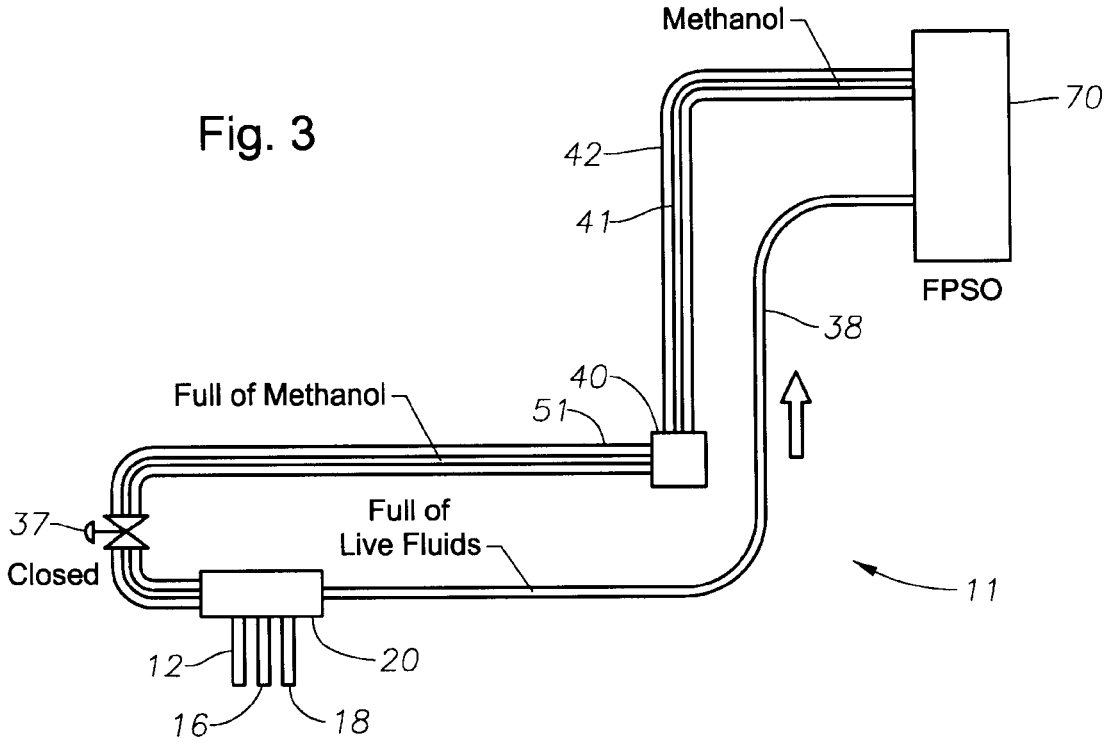
FIG. 3 provides a somewhat schematic side view of a production line and an umbilical as part of a subsea production system. The production line and umbilical each tie into a manifold at one end, and to an FPSO at the other end. In this view, production is being obtained through the production line.

The process of displacing uninhibited production fluids using a tubing in the service umbilical line 42 is illustrated in the following figures:

FIG. 3 provides a side view of a production line 38 and a utility umbilical. The umbilical represents both a primary umbilical line 42 and a manifold umbilical line 51. The umbilicals 42, 51 are connected to each other at a UTA 40. The utility umbilicals 42, 51 again represent integrated umbilicals where control lines, conductive power lines, and/or chemical lines are bundled together for delivery of hydraulic fluid, electrical power, chemical inhibitors or other components to other subsea equipment and lines. The bundled umbilical lines 42, 51 may be made up of thermoplastic hoses of various sizes and configurations. In one known arrangement, a nylon "Type 11" internal pressure sheath is utilized as the inner layer. A reinforcement layer is provided around the internal pressure sheath. A polyurethane outer sheath may be provided for water proofing. Where additional collapse resistance is needed, a stainless steel internal carcass may be disposed within the internal pressure sheath. An example of such an internal carcass is a spiral wound interlocked 316 stainless steel carcass. Where colder temperatures and higher pressures are encountered, the umbilicals 42, 51 may be comprised of a collection of separate steel tubes bundled within a flexible vented plastic tube. The use of steel tubes, however, reduces line flexibility. It is understood that the methods of the present invention are not limited by any particular umbilical arrangements so long as the utility umbilicals 42, 51 each include a chemical injection tubing 41. The chemical tubing 41 is sized to accommodate the pumping of a displacement fluid. In one embodiment, the chemical tubing within the umbilical 51 is a 3-inch line, while the chemical tubing in the umbilical 42 is 3½-inches ID.

The production line 38 ties into a manifold 20 at one end, and to an FPSO 70 at the other end. An intermediate sled and jumper line (not shown) may be used. The production line 38 may be, in one aspect, an 8-inch line. Alternatively, the production line 38 may be a 10-inch line. Preferably, the production line 38 is insulated with an outer and, possibly, an inner layer of thermally insulative material. The subsea umbilical 51 is fluidly connected to the manifold 20, while the utility umbilical 42 preferably ties back to the FPSO 70. The two umbilicals 42/51 are preferably connected via a UTA 40. A valve 37 is provided at or near the junction between the subsea umbilical 51 and the manifold 20. The valve 37 allows selective fluid communication between the chemical tubing 41 within the umbilicals 42/51 and the manifold 20. In the view of FIG. 3, the valve 37 is closed.

In one illustrative embodiment, the umbilical lines 42, 51 together are 10.3 km, and the production line 38 is 10.5 km. A 3-inch ID chemical tubing 41 of that length may receive 300 to 375 barrels of fluid. The 8-inch production line holds approximately 1,885 barrels of fluid. Of course, other lengths and diameters for the lines 41, 38 may be provided. For example, the chemical tubing 41 may have an inner diameter of 3½-inches, and the production line may have an inner diameter of 10-inches.

In FIG. 3, production is being obtained through the production line 38. More specifically, oil, water and gas ("live fluids") are being produced from a subsurface formation (not shown) through the manifold 20 and through the production line 38. Again, the line 38 is preferably insulated in such as way that the produced fluids retain their heat and arrive at a separator (not shown) on the gathering facility 70 at a temperature higher than the hydrate formation temperature. The insulation quality of the production line 38 should be such that the uninhibited production fluids in the line 38 remain above the hydrate formation temperature for a period of time defined as the cool down time, which is the time where no action is required by the operator to prevent hydrate formation in an essentially static condition, plus the time it takes to displace the production fluids to the gathering facility 70.

As noted, during normal production the chemical tubing 41 is preferably filled with an inhibitor fluid such as methanol. The displacement fluid is optionally maintained in the chemical tubing 41 for reserve in the event the production line 38 is shut in. In the view of FIG. 3, the chemical tubing 41 is filled with methanol. The valve 37 remains closed, with the methanol in reserve.

Figure 4:
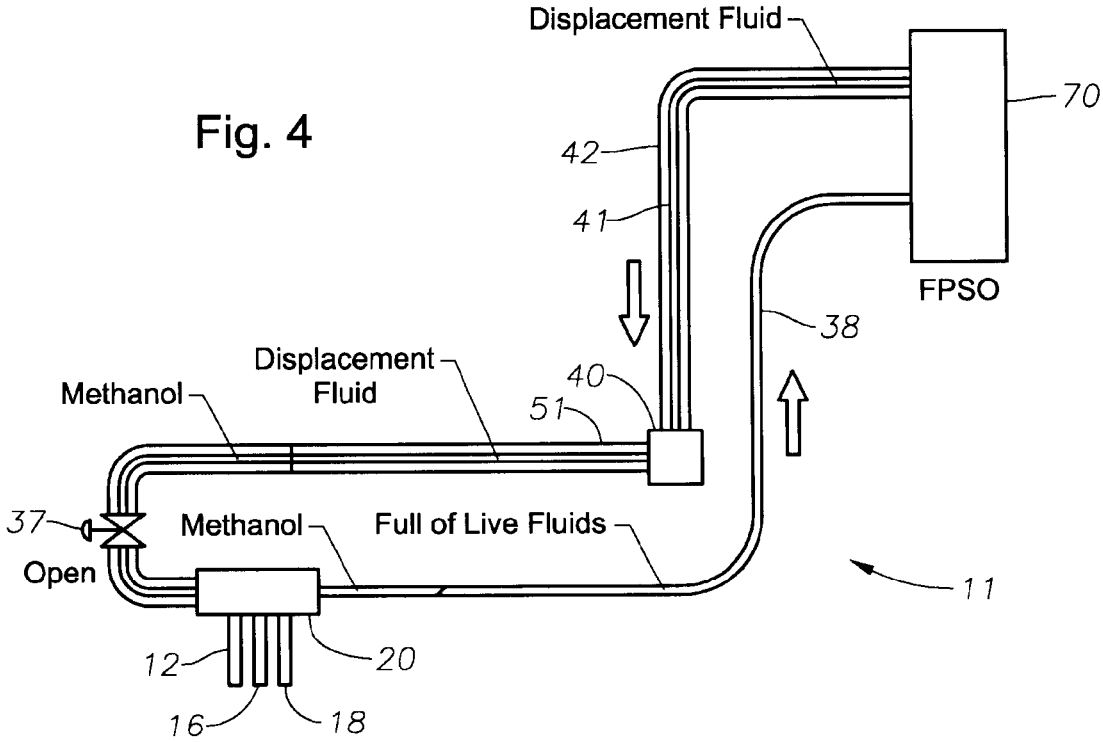
FIG. 4 shows the production line and umbilical of FIG. 3. Production from the production line has been shut-in. A displacing fluid is being pumped through the umbilical and through the manifold, and into the production line.

FIG. 4 shows the production line 38 and umbilicals 42, 51 of FIG. 3. Flow of produced fluids from the wells 12, 16, 18 and through the production line 38 has now been shut-in. It is thus desirable to displace the produced fluids from the production line 38 before hydrate formation begins to occur. To this end, the inhibitor "pill" is pumped through the umbilicals 42, 51. More specifically, the inhibitor is pumped through the chemical tubing 41, through the valve 37, through the manifold 20 and into the production line 38. No pig is required. In FIG. 4, methanol is beginning to invade the production line 38.

It is acknowledged that initial displacement of the produced fluids by pumping of the inhibitor and without a pig is inefficient. This is particularly true where pumping is at a relatively low velocity. Movement of the inhibitor fluid into the production line 38 allows some bypassing of fluids by the methanol. Further, the methanol in the tubing 41 will be at ambient sea temperature, which is below the hydrate formation temperature of the uninhibited production fluids in the production line 38. The cold methanol will cool the production fluids to temperatures below the uninhibited hydrate formation temperature. Thus, displacement without a pig and with fluids that are below the hydrate formation temperature is counter-intuitive. However, methanol is a thermodynamic inhibiting chemical and will depress hydrate formation temperature in production fluids, thereby preventing hydrate formation. Displacing methanol out of the service tubing 41 and into the production line 38 ahead of a displacement fluid such as dead crude oil or diesel will ensure that all uninhibited production fluids in the production line 38, which is not displaced out of the line 38, will be inhibited. Where a pig is not used for displacement it is important that a sufficient quantity of hydrate inhibiting chemical be used so as to ensure that all production fluids which are not displaced are hydrate inhibited.

The methanol (or other hydrate inhibitor) is pumped using the primary displacement fluid. As noted, the displacement fluid is preferably either a dehydrated crude oil or diesel. The methanol generally isolates the live fluids in the production line 38 from the cold dead crude or other displacement fluid. Preferably, the production line 38 will be depressurized after the methanol is moved through the chemical tubing 41 but before the displacement fluid reaches the manifold 20. This further reduces the risk of hydrate formation. In one embodiment, the line is depressurized for a period of one hour. In one aspect, the depressurization is conducted during the cool down period. In another aspect, the depressurization is conducted after the cool down time period.

Next, dead crude or diesel is further pumped into the chemical tubing 41 to continue to displace fluids out of the production line 38. Pumping should preferably take place at a high rate. For example, dead crude may be injected at a rate of 5 to 8 kbpd to achieve desired displacement of live fluids. The injection rate may be limited to 8 kbpd if necessary for FPSO processes.

It is noted from FIGS. 2-4 that the production line 38 runs "uphill" from the well manifold 20 to the FPSO 70. If a well is shut in for 8 hours, the produced fluids in the production line 38 will largely segregate into layers of water, live oil and gas. Variable terrain, emulsions or foaming will restrict segregation. When displacement begins, the methanol pill enters the well manifold end of the production line 38, which is followed by the dead crude. The behavior of the interfaces between these layers is noted as follows:

Live oil and gas interface. Due to the uphill geometry and the lower density of gas as compared to the live oil, most gas naturally flows towards the FPSO 70. Some gas is trapped at high points in the system. However, the methanol pill will treat this gas. Also, the dead crude or diesel may absorb the gas and transport it to the FPSO 70.

Water and live oil interface. Due to the uphill geometry and the lower density of live oil/diesel as compared to the water, most live oil naturally flows towards the FPSO 70.

Methanol and water interface. Due to the uphill geometry and the lower density of methanol as compared to the water, the methanol could overrun and bypass the water if the flow rate is too low. In one embodiment where displacement is pumped at a rate of 5.0 kbpd into a 10-inch production line 38, the methanol/water interface Reynolds number is 44,000, which indicates turbulent flow. Also, methanol is miscible in water. Therefore, there should be good mixing and sweep of the water by methanol. The volume and behavior of the methanol is a function of various factors, such as injection tubing ID and flowline ID. The chemical injection tubing preferably has an inner diameter of 3 and ½ inches, though this may be adjusted. Subsea flowlines typically have an inner diameter of 4 inches to 10 inches. The pump rate will also vary depending upon line capacity, line ID, fluid viscosity, and so forth.

Displacement fluid/methanol interface. Displacement fluid should not overrun methanol in uphill flow due to (1) the gravity effects of the higher density of dead crude (900 kg/m3) as compared to methanol (797 kg/m3), and (2) the higher viscosity of dead crude (199 cp) than methanol (0.5 cp), which makes the dead crude more resistant to flow than methanol. At an average rate of 5.0 kbpd in a 10-inch line, the dead crude Reynolds number is 327, which indicates laminar flow. Therefore, there should be very little mixing of dead crude and methanol. It is understood that these numbers are merely for illustration. The volume and behavior of the displacement fluid is also a function of various factors, such as flowline ID. The pump rate will also vary depending upon line capacity, line ID, fluid viscosity, and so forth.

The operator may choose to periodically monitor the displacement efficiency of the displacement fluid. For example, the fluids recovered at the FPSO 70 may be sampled every two hours and analyzed for water and methanol content. The dead oil (or diesel) injection rate during displacement might be compared to predicted values. It has been observed that higher pump rates will improve the displacement efficiency, while lower rates will lower the displacement efficiency. At the time when the predicted remaining aqueous phase volume equals the methanol pill volume, the methanol content in the sampled aqueous phase should be rapidly increasing. For example, after 12 or 16 hours of displacement for 8-inch and 10-inch lines, respectively, the sampled aqueous phase should have a high methanol concentration.

If after 12 or 16 hours of displacement for 8-inch and 10-inch lines, respectively, the sampled aqueous phase does not have a substantial methanol concentration, e.g., 1.0 bbl methanol per 1.0 bbl water, then it is recommended that future displacements utilize additional methanol injection. For example, the volume of the methanol pill could be increased from 400 to 500 barrels by injecting methanol at the well manifold via umbilical methanol supply lines (not separately shown) while injecting dead crude into the chemical tubing 41.

Figure 5:
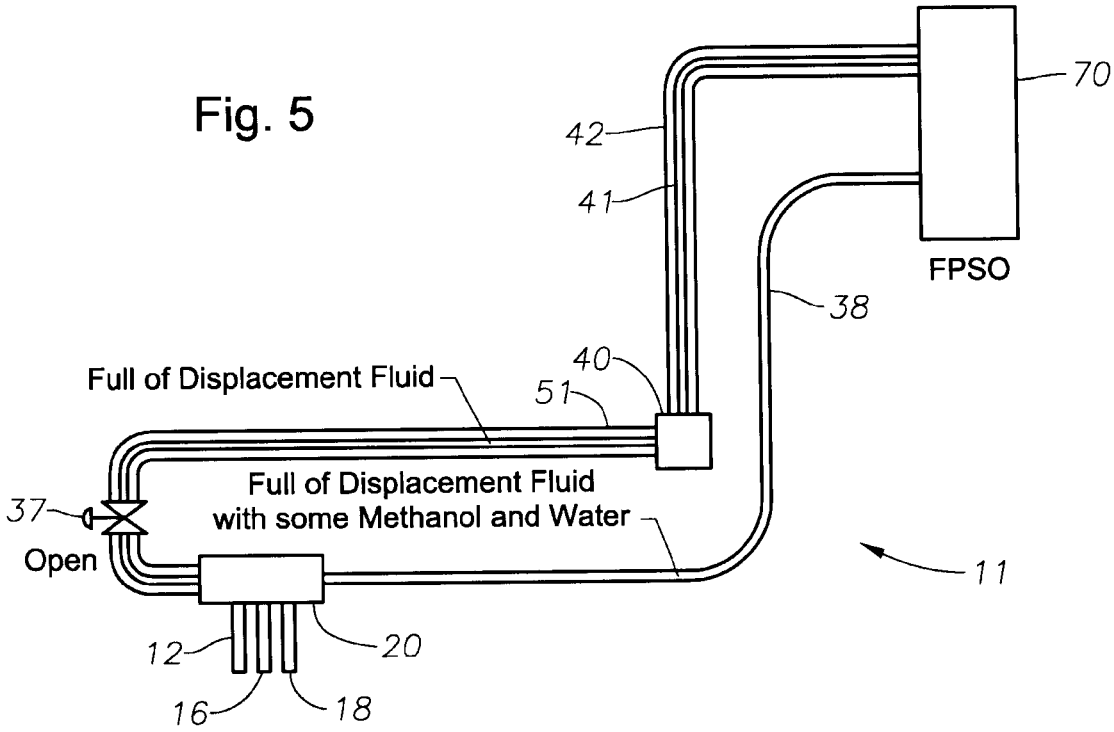
FIG. 5 shows the production line and umbilical of FIG. 3. Here, produced fluids in the production line and chemical inhibitor have been substantially displaced from both the umbilical and the production line.

Moving now to the next drawing, FIG. 5 depicts the state of the system 11 after the production line fluids are substantially inhibited and substantially displaced. The gate 37 remains open. Both the chemical tubing 41 and the production line 38 are now substantially filled with displacement fluids, though the production line 38 may have some remaining methanol and water. To the extent any water remains in the production line 38 due to pumping bypass, such will now be inhibited from hydrate formation due to the prior injection of and mixing with methanol. In one embodiment of the hydrate management methods herein, the operator may continue to inject dead crude or diesel into the chemical tubing 41 for an additional length of time, such as four hours, to ensure that water has been displaced from the production line 38 and that methanol has treated the entire length of the line 38. In this instance, the total duration of displacement fluid injection is increased to 16 and 20 hours for 8-inch and 10-inch lines, respectively, for example.

Figure 7:
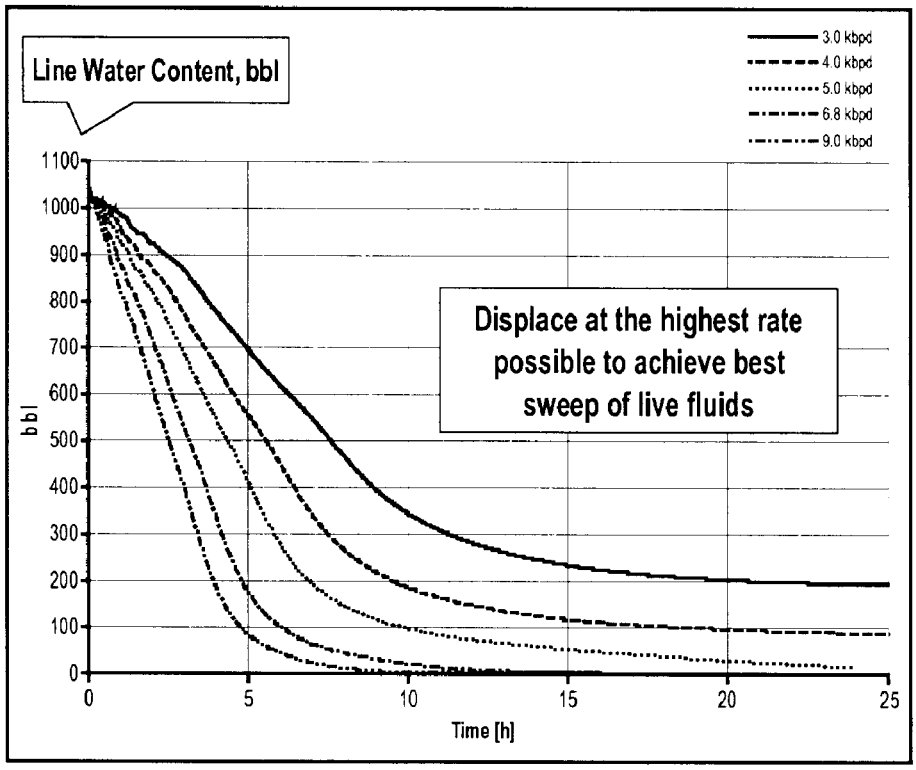
FIG. 7 is a chart showing 8-inch flowline water content during displacement as a function of dead crude injection rate.

Referring now to FIG. 7, a chart 700 is provided showing 8-inch flowline 38 water content during displacement as a function of dead crude injection rate. The production line 38 was producing wells with a 72% watercut at the time of shut-in, and had been shut-in for 8 hours. Time 0 on the plot 700 represents the beginning of the displacement process.

As shown in FIG. 5, the dead crude should be circulated at the highest possible rate to achieve the best sweep of live fluids. Preferably, the pump rate should be greater than 5 kbpd, and more preferably 5 to 9 kbpd.

Figure 6:
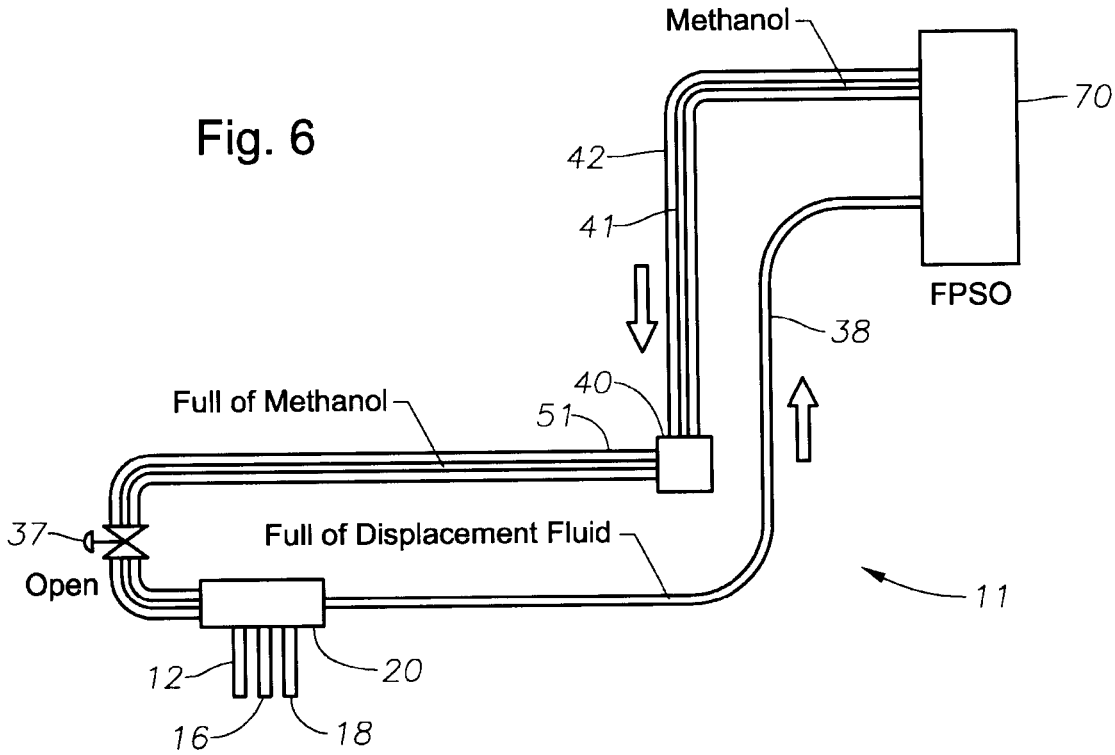

FIG. 6 depicts the state of the system 20 after expected full aqueous phase displacement/inhibition and prior to well restart. Methanol or other inhibitor has been reinjected into the chemical tubing 41. The displacement fluid has been pushed by the methanol through the valve 37, into the manifold 20, and into the production line 38. The displacement fluid, in turn, has displaced the methanol and produced fluids that were ahead of it. The produced fluids are received at the gathering facility 70. Fluids are preferably received into a high pressure separator, or they can be routed to a flare scrubber. Liquids are stored preferably in an "off-spec" tank, while gas may be routed to flare.

FIGS. 3-6 depict the displacement of fluids without a pig. It is preferred that a pig not be employed, as the substantial difference in diameter between the chemical injection tubing 41 and the production line 38 creates difficult design issues. However, the methods may also be conducted with a pig between an inhibitor "pill" and the displacement fluid. In either option, the current methods provide a lower volume of chemical inhibitor, thereby saving the operator money.

In order to displace the uninhibited production fluids from the production line 38 using a pig, a pig would be placed in the chemical injection tubing 41 of the umbilical line 42. The pig is pumped through the umbilical line 42 using a displacing fluid, such as diesel. In one aspect, the pig is pumped from the FASO 75, through the chemical tubing 41, and to the manifold 20. Valves (not shown) on the manifold 20 are controlled so that the pig and displacing fluid move through the manifold and into the production line 38. The pig and displacing fluid are then pumped through the production line 38 and to the gathering facility 70. In this way, hydrate blockage during a production shut-in is avoided.

Before production from the subsea system 11 is resumed, the chemical tubing 41 should preferably be refilled with methanol or other inhibitor of choice. A complete sweep of the displacement fluid from the tubing 41 is desired. If a gel or foam pig is used to isolate methanol from displacement fluid, filling the tubing 41 at 3.4 kbpd rate for a 3 and ½ inch tubing ID will yield a 1.0 m/s velocity in the tubing 41. In one instance, flowing about 410 bbl of methanol provides a 10% margin for the tubing 41 with a 375 bbl volume. If no pig is used to isolate methanol from displacement fluid, the chemical tubing 41 should preferably be filled at the fastest rate possible (4.2 kbpd rate, for example). The methanol may overrun the displacement fluid some, since the methanol has a lower viscosity (0.5 cp) than the displacement fluid (dead oil, for example, has a viscosity of 199 cp). The lighter density of methanol (797 kg/m3) than dead oil (900 kg/m3) will tend to reduce methanol overrun of dead oil in downhill flow. Flowing about 450 bbl of methanol provides a 20% margin for a tubing 41 with a 375 bbl volume.

As noted, the preferred displacement fluid is either dehydrated and degassed crude oil or diesel. Different design considerations come into play, depending upon which displacement fluid is used. The following tables (Tables 1-4) provide volumetric comparisons when using either dehydrated crude oil or diesel. In Tables 1 and 2, produced fluids are displaced through 8- and 10-inch lines, respectively, using methanol followed by dead crude. In Tables 3 and 4, produced fluids are displaced through 8- and 10-inch lines, respectively, using methanol followed by diesel.

TABLE 1

Methanol/Dead Crude Displacement - 8" Line

| Scenario | | 3.5" ID US Line | 8" NPS Line | Loop Total |
|---|---|---|---|---|
| Flowline ID | (in) | 3.50 | 7.50 | |
| Flowline Length | (m) | 8,306 | 8,819 | |
| Flowline Volume | (bbl) | 324 | 1,581 | 1,905 |
| Riser ID | (in) | 3.50 | 7.50 | |
| Riser Length | (m) | 1,222 | 1,078 | |
| Riser Volume | (bbl) | 48 | 193 | 241 |
| Flexible | (in) | 3.50 | 7.50 | |
| Flexible Length | (m) | — | 548 | |
| Flexible | (bbl) | — | 98 | 98 |
| Topsides Line | (in) | 3.50 | 7.50 | |
| Topsides Line | (m) | 70 | 70 | |
| Topsides Line | (bbl) | 3 | 13 | 15 |
| Total Length | (m) | 9,598 | 10,515 | 20,113 |
| Total Volume | (bbl) | 375 | 1,885 | 2,260 |
| Total Volume | (m3) | 60 | 300 | 359 |
| Dry Oil Storage | (bbl) | — | — | 5,333 |
| Wet Liquids Storage | (bbl) | — | — | 5,333 |
| Injection | (stbpd) | 5,250 | 5,250 | 5,250 |
| | (m3/h) | 35 | 35 | 35 |
| Average Velocity | (m/s) | 1.56 | 0.34 | na |
| Duration | (hrs) | 1.7 | 8.6 | 10.3 |
| Start Time | (h:mm) | 8:00 | 9:42 | 8:00 |
| Finish | (h:mm) | 9:42 | 18:19 | 18:19 |
| Cool Down | (hrs) | na | 20.0 | na |

TABLE 2

Methanol/Dead Crude Displacement - 10" Line

| Scenario | | 3.5" ID US Line | 10" NPS Line | Loop Total |
|---|---|---|---|---|
| Flowline ID | (in) | 3.50 | 9.50 | |
| Flowline Length | (m) | 8,306 | 8,819 | |
| Flowline Volume | (bbl) | 324 | 2,537 | 2,861 |
| Riser ID | (in) | 3.50 | 9.50 | |
| Riser Length | (m) | 1,222 | 1,078 | |
| Riser Volume | (bbl) | 48 | 310 | 358 |
| Flexible | (in) | 3.50 | 9.50 | |
| Flexible Length | (m) | — | 548 | |
| Flexible | (bbl) | — | 158 | 158 |
| Topsides Line | (in) | 3.50 | 9.50 | |
| Topsides Line | (m) | 70 | 70 | |
| Topsides Line | (bbl) | 3 | 20 | 23 |
| Total Length | (m) | 9,598 | 10,515 | 20,113 |
| Total Volume | (bbl) | 375 | 3,025 | 3,399 |
| Total Volume | (m3) | 60 | 481 | 540 |
| Dry Oil Storage | (bbl) | — | — | 6,667 |
| Wet Liquids Storage | (bbl) | — | — | 6,667 |

TABLE 2-continued

| Methanol/Dead Crude Displacement - 10" Line | | | | |
|---|---|---|---|---|
| Scenario | | 3.5" ID US Line | 10" NPS Line | Loop Total |
| Injection | (stbpd) | 5,250 | 5,250 | 5,250 |
| | (m3/h) | 35 | 35 | 35 |
| Average Velocity | (m/s) | 1.56 | 0.21 | na |
| Duration | (hrs) | 1.7 | 13.8 | 15.5 |
| Start Time | (h:mm) | 8:00 | 9:42 | 8:00 |
| Finish | (h:mm) | 9:42 | 23:31 | 23:31 |
| Cool Down | (hrs) | na | 24.0 | na |

In Tables 1 and 2, produced fluids are displaced using methanol and "dead crude." The "flowline length" and "riser length" together provide a total length of line originally having uninhibited produced fluids. A 3½-inch chemical injection tubing 41 is used for fluid displacement. During normal operations, the chemical injection tubing 41 of the utility lines 42, 51 is preferably left full of roughly 375 bbl of methanol. During displacement, this methanol forms a pill in the flowline 38 that isolates the live fluids from the cold dead crude. The pill is 2.1 and 1.3 km long in the 10.5 km 8-inch and 10-inch lines, respectively.

The dead crude displacement fluid should be injected into the chemical tubing 41 at the maximum allowable pressure. The maximum allowable dead crude pumping system discharge pressure is estimated to be 191 bara, atm. in one pumping system. Injection rates also affect displacement time requirements. It is noted that the preferred minimum displacement time requirements for 8-inch and 10-inch lines in the above test are 10 and 15 hours, respectively. Adding in 6 hours of cool down time, 2 hours of light touch time, and 1 to 2 hours of contingency time yields a total cool down time requirement of 20 and 24 hours for 8-inch and 10-inch lines, respectively. These times will vary depending upon injection rates and the use of other flowline geometries.

To further reduce the risk of hydrate formation, the arrival pressure may be reduced. This, in turn, increases the displacement efficiency rate. In addition, the viscosity of the dead oil displacement fluid may be reduced by using a warmer fluid. This can be achieved by utilizing the warmest dead crude from the most recently filled cargo tank, and/or by slightly insulating the utility line 42. Alternatively, a more durable chemical injection tubing could be used, thereby permitting more vigorous injection rates. For instance, increasing the flowline rating from 301 bara to 351 bara atm. increases the water displacement efficiency rate by an estimated 26%. Finally, a viscosity reducing agent may be injected into the circulated dead oil. Reducing the dead oil viscosity from 125 to 10 cp increases the displacement efficiency rate by an estimated 41%.

Simulations have been conducted for displacing produced fluids from an 8-inch production line using dehydrated crude oil as the displacement fluid. It was found in one model that optimum fluid displacement was realized using a methanol "pill" of 375 to 404 barrels, pumped for 12 hours. The dead crude rate ranged from 2.0 to 7.7 kbpd. The aqueous phase (water plus methanol) content after 12 hours of displacement was 41 bbl. It is therefore expected that the remaining aqueous phase in the line will be nearly pure methanol.

Simulations were also conducted for displacing produced fluids from a 10-inch production line using dehydrated crude oil as the displacement fluid. It was again found that optimum fluid displacement was realized using a methanol "pill" of 375 to 404 barrels, but pumped for 16 hours. The dead crude rate ranged from 4.9 to 8.1 kbpd.

Figure 8:
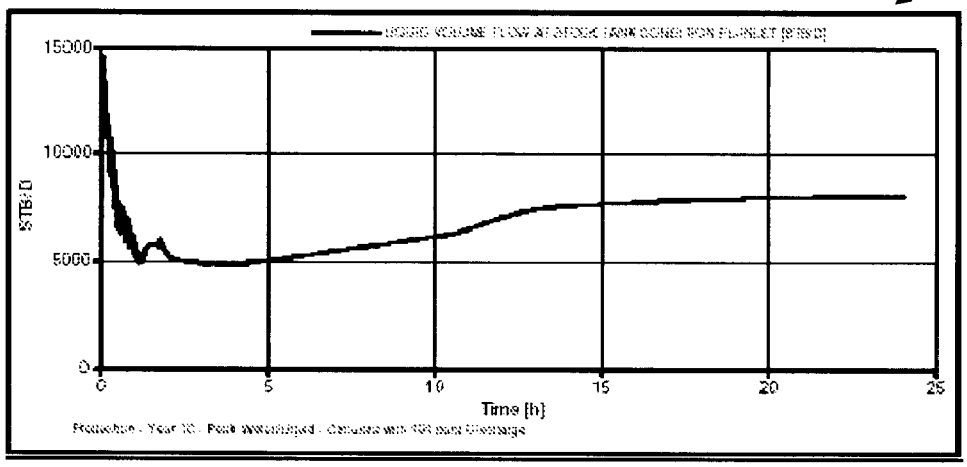
FIG. 8 is a chart providing a demonstration of flow rate during fluid displacement.

Referring now to FIG. 8, a chart 800 provides a demonstration of flow rate during fluid displacement. The early peak is due to the low viscosity of the methanol originally in the chemical injection tubing 41. After the dead crude fills the chemical injection tubing 41, the flow rate reaches a minimum of 4.9 kbpd. As the 38° C. dead crude warms the tubing 41, the dead crude viscosity decreases, which allows the dead crude flow rate to increase to 8.1 kbpd.

Figure 9:
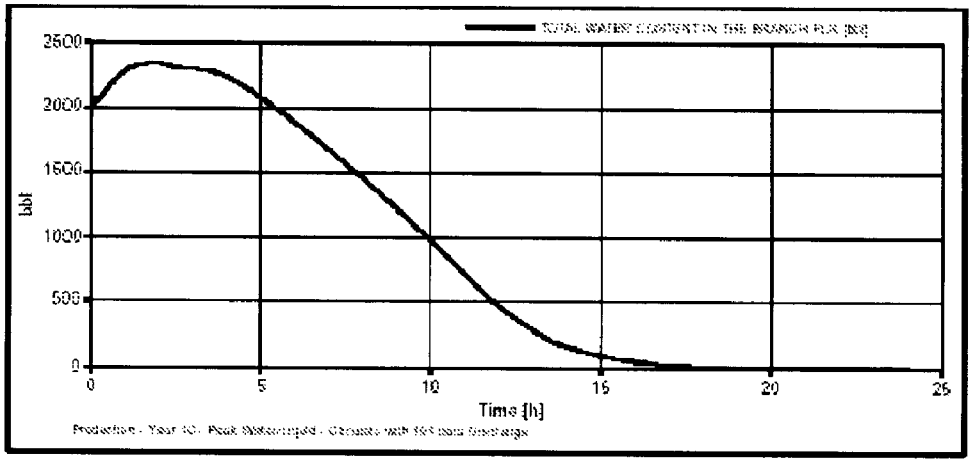
FIG. 9 is a chart presenting water displacement for a 10-inch line.

FIG. 9 provides a chart 900 presenting water displacement for a 10-inch line. Note that the aqueous phase first increases while the methanol flows from the chemical injection tubing 41 into the production line 38, and then decreases as the dead crude displaces the aqueous phase to the FPSO 70.

Simulations were also conducted for displacing produced fluids from an 8-inch production line using diesel as the displacement fluid. It was found in one test that diesel should be pumped into the chemical injection tubing 41 at a rate of 8.0 kbpd. For 8 hours in order to obtain optimum displacement. A methanol pill of 275 barrels was used to partially displace and partially inhibit produced fluids from the production line 38 ahead of the diesel. A total diesel volume of 2,700 barrels was injected to then displace the methanol and remaining produced fluids.

A similar volume for recovered live fluid storage is also required, and can be broken down as follows. A 50% watercut is used as an example:

Recovered live crude is equivalent to chemical line volume×0.95×(1−watercut)=1,885 bbl×(1-0.50)=895 bbl crude;

Recovered water is equivalent to chemical line volume×0.95×(watercut)=1,885 bbl×(0.50)=895 bbl water;

Recovered methanol=chemical line volume+injected methanol=275+0 bbl=275 bbl methanol; and Recovered diesel is equivalent to injected−line−chemical line volume=(2,700−1,885−275 bbl)=540 bbl diesel.

Total liquids recovered during displacement therefore are 2,605 bbl.

If a higher injection rate for the methanol and the diesel can be achieved, then the injection time period can be reduced. The total injected diesel volume is still 2,700 barrels. The volume of the methanol pill can be increased from 275 barrels up to a maximum of 980 barrels by injecting methanol at the well manifold via a separate chemical injection line while injecting diesel into the chemical tubing 41. Increasing the methanol pill size allows the operator to reduce the diesel injection duration and total injection volume. Since the methanol resides mainly in the aqueous phase with water, adding methanol will hasten the displacement of water from the lines.

After the diesel front reaches the well manifold, the cold diesel (approximately 5 cp) in the 8-inch line will have a Reynolds number of 15000, which indicates turbulent flow. There would be good mixing and contact of diesel and methanol with any remaining water. It is therefore acceptable to continue any additional methanol injection at the well manifold beyond the time the diesel front reaches the well manifold. If methanol is injected at a 14 $m^3$/hr during an 8 hour displacement period, then 704 barrels of methanol would be added.

The following tables (Tables 3 and 4) show the remaining production line 38 aqueous phase content over time for a range of diesel injections. The amount of methanol required to treat the remaining aqueous phase assumes a factor of two error in aqueous phase volume prediction. Note that the methanol volume may not be less than the 275 to 287 barrel volume of the 3.0-inch ID line 41. The diesel, methanol and total costs of the displacement are calculated, assuming the displacement is halted at the tabulated time. Displacement for 7 hours at an 8.0 kbpd rate for an 8-inch line minimizes total cost and methanol consumption. An additional hour of displacement is recommended.

TABLE 3

Comparing Diesel and Methanol Volumes and Costs 8" Line Methanol and Diesel Displacement

| Displacement Time, hours | Diesel Rate, kbpd | Diesel Volume, bbl | Diesel Cost, k$ (1 $/gal - 15 $/bbl) | Aqueous Content At This Time, bbl | Methanol Volume, bbl (+100%) | Methanol Cost, k$ (1 $/gal) | Displaced Volume, bbl | Total Cost, k$ |
|---|---|---|---|---|---|---|---|---|
| 4 | 8.0 | 1333 | 36 | 824 | 1648 | 69 | 2681 | 105 |
| 5 | 8.0 | 1667 | 45 | 496 | 992 | 42 | 2359 | 87 |
| 6 | 8.0 | 2000 | 54 | 235 | 470 | 20 | 2170 | 74 |
| 7 | 8.0 | 2333 | 63 | 117 | 275 | 12 | 2308 | 75 |
| 8 | 8.0 | 2667 | 72 | 70 | 275 | 12 | 2642 | 84 |
| 9 | 8.0 | 3000 | 81 | 47 | 275 | 12 | 2975 | 93 |
| 10 | 8.0 | 3333 | 90 | 32 | 275 | 12 | 3308 | 102 |
| 12 | 8.0 | 4000 | 108 | 12 | 275 | 12 | 3975 | 120 |
| 14 | 8.0 | 4667 | 126 | 3 | 275 | 12 | 4642 | 138 |
| 16 | 8.0 | 5333 | 144 | 0 | 275 | 12 | 5308 | 156 |
| 4 | 7.0 | 1167 | 32 | 974 | 1948 | 82 | 2815 | 113 |
| 5 | 7.0 | 1458 | 39 | 691 | 1382 | 58 | 2540 | 97 |
| 6 | 7.0 | 1750 | 47 | 417 | 834 | 35 | 2284 | 82 |
| 7 | 7.0 | 2042 | 55 | 229 | 458 | 19 | 2200 | 74 |
| 8 | 7.0 | 2333 | 63 | 139 | 278 | 12 | 2311 | 75 |
| 9 | 7.0 | 2625 | 71 | 93 | 275 | 12 | 2600 | 82 |
| 10 | 7.0 | 2917 | 79 | 67 | 275 | 12 | 2892 | 90 |
| 12 | 7.0 | 3500 | 95 | 39 | 275 | 12 | 3475 | 106 |
| 14 | 7.0 | 4083 | 110 | 21 | 275 | 12 | 4058 | 122 |
| 16 | 7.0 | 4667 | 126 | 10 | 275 | 12 | 4642 | 138 |
| 4 | 6.0 | 1000 | 27 | 1120 | 2240 | 94 | 2940 | 121 |
| 5 | 6.0 | 1250 | 34 | 881 | 1762 | 74 | 2712 | 108 |
| 6 | 6.0 | 1500 | 41 | 642 | 1284 | 54 | 2484 | 94 |
| 7 | 6.0 | 1750 | 47 | 410 | 820 | 34 | 2270 | 82 |
| 8 | 6.0 | 2000 | 54 | 263 | 526 | 22 | 2226 | 76 |
| 9 | 6.0 | 2250 | 61 | 179 | 358 | 15 | 2308 | 76 |
| 10 | 6.0 | 2500 | 68 | 132 | 275 | 12 | 2475 | 79 |
| 12 | 6.0 | 3000 | 81 | 83 | 275 | 12 | 2975 | 93 |
| 14 | 6.0 | 3500 | 95 | 59 | 275 | 12 | 3475 | 106 |
| 16 | 6.0 | 4000 | 108 | 44 | 275 | 12 | 3975 | 120 |

TABLE 4

(Comparing Diesel and Methanol Volumes Using an 8-Inch Production Line)
Comparing Diesel and Methanol Volumes and Costs 10" Line Methanol and Diesel Displacement

| Displacement Time, hours | Diesel Rate, kbpd | Diesel Volume, bbl | Diesel Cost, k$ (1 $/gal - 15 $/bbl) | Aqueous Content At This Time, bbl | Methanol Volume, bbl (+100%) | Methanol Cost, k$ (1 $/gal) | Displaced Volume, bbl | Total Cost, k$ |
|---|---|---|---|---|---|---|---|---|
| 4 | 8.9 | 1485 | 40 | 1755 | 3510 | 147 | 4695 | 188 |
| 6 | 8.9 | 2228 | 60 | 1116 | 2232 | 94 | 4160 | 154 |
| 8 | 8.9 | 2970 | 80 | 573 | 1146 | 48 | 3816 | 128 |
| 10 | 8.9 | 3713 | 100 | 344 | 688 | 29 | 4101 | 129 |
| 12 | 8.9 | 4455 | 120 | 241 | 482 | 20 | 4637 | 141 |
| 14 | 8.9 | 5198 | 140 | 189 | 378 | 16 | 5276 | 156 |
| 16 | 8.9 | 5940 | 160 | 158 | 316 | 13 | 5956 | 174 |
| 4 | 8.0 | 1333 | 36 | 1880 | 3760 | 158 | 4793 | 194 |
| 6 | 8.0 | 2000 | 54 | 1243 | 2486 | 104 | 4186 | 158 |
| 8 | 8.0 | 2667 | 72 | 664 | 1328 | 56 | 3695 | 128 |
| 10 | 8.0 | 3333 | 90 | 402 | 804 | 34 | 3837 | 124 |
| 12 | 8.0 | 4000 | 108 | 287 | 574 | 24 | 4274 | 132 |
| 14 | 8.0 | 4667 | 126 | 230 | 460 | 19 | 4827 | 145 |
| 16 | 8.0 | 5333 | 144 | 197 | 394 | 17 | 5427 | 161 |
| 4 | 7.0 | 1167 | 32 | 2020 | 4040 | 170 | 4907 | 201 |
| 6 | 7.0 | 1750 | 47 | 1480 | 2960 | 124 | 4410 | 172 |
| 8 | 7.0 | 2333 | 63 | 921 | 1842 | 77 | 3875 | 140 |
| 10 | 7.0 | 2917 | 79 | 576 | 1152 | 48 | 3769 | 127 |
| 12 | 7.0 | 3500 | 95 | 418 | 836 | 35 | 4036 | 130 |
| 14 | 7.0 | 4083 | 110 | 336 | 672 | 28 | 4455 | 138 |
| 16 | 7.0 | 4667 | 126 | 291 | 582 | 24 | 4949 | 150 |

It is noted that diesel should preferably not overrun the methanol for the following reasons:

the gravity effects of the higher density diesel (818 kg/m3) as compared to methanol (797 kg/m3) in uphill flow; and the higher viscosity of diesel (5 cp) as compared to methanol (0.5 cp), which makes the diesel more resistant to flow than methanol.

Figure 10:
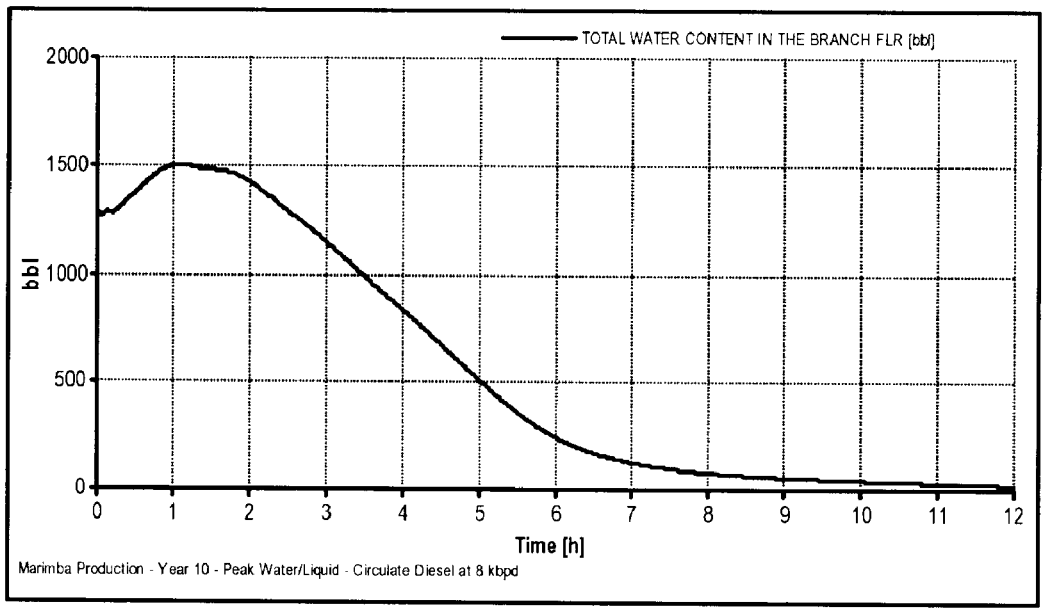
FIG. 10 is a chart demonstrating water displacement using diesel as the displacement fluid.

The chart 1000 of FIG. 10 demonstrates water displacement using diesel as the displacement fluid. Note that the aqueous phase first increases while the methanol flows from the chemical injection tubing 41 into the production line 38, and then decreases as the diesel displaces the aqueous phase to the FPSO 70.

Figure 11:
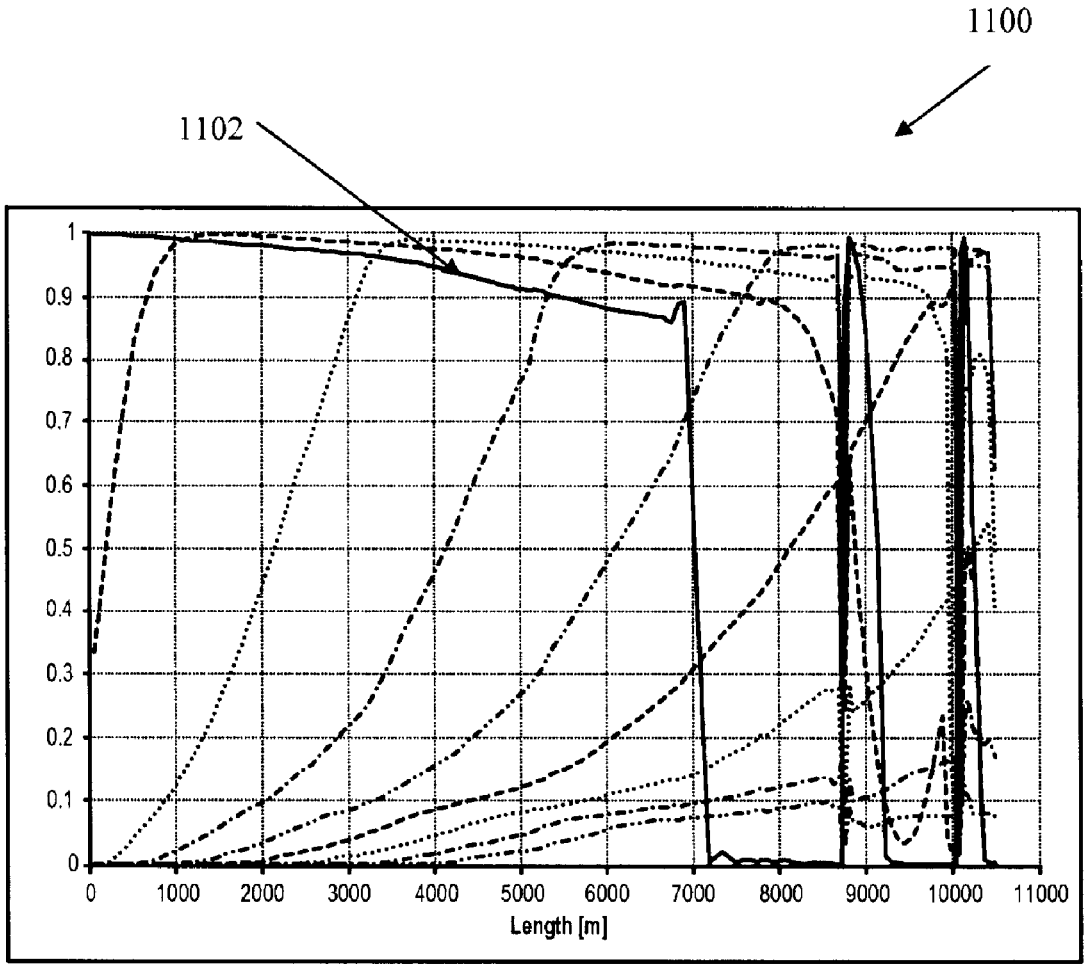
FIG. 11 is a profile plot of the aqueous phase content in an 8-inch line.

A profile plot of the aqueous phase content in the 8-inch line is shown in the chart 1100 of FIG. 11. The solid black curve 1102 shows water holdup volume fraction after 8 hours of shut-in time. The other curves show the water holdup fraction in one hour increments. After 8 hours of displacement, the line aqueous phase content is 70 bbl.

A method for transporting hydrocarbons from an offshore production facility is also provided herein. In this method, the production facility receives produced hydrocarbons from one or more subsea wells, and from a production line associated with the one or more subsea wells. The subsea wells and production line are associated with a subsea production system. The method generally comprises the steps of shutting in the flow of produced fluids from the subsea well and the production line; pumping a displacement fluid from the production facility into a chemical injection tubing, the chemical injection tubing being within an umbilical; further pumping the displacement fluid into the chemical injection tubing so that displacement fluid is urged through a subsea manifold and into the production line; further pumping the displacement fluid through the production line so as to displace the produced fluids before hydrate formation begins; re-initiating the flow of produced fluids from the subsea wells and through the production line to the production facility; and transporting the produced fluids from the offshore production facility.

In one aspect, the step of transporting the produced fluids from the offshore production facility comprises offloading the produced fluids from the offshore production facility onto a tanker; and transporting the produced fluids to an onshore terminal.

The subsea production system further comprises a jumper for delivering produced fluids from the subsea well to a manifold, and a valve for selectively placing the chemical injection tubing in fluid communication with the manifold. The umbilical further comprises a first umbilical portion that connects the gathering facility with an umbilical termination assembly, and a second umbilical portion that connects the umbilical termination assembly with the manifold. The production line comprises a production riser in fluid communication with the production facility, and a flowline for placing the manifold in fluid communication with the production riser.

While the foregoing is directed to embodiments of the present invention, other and further embodiments of the invention may be devised without departing from the basic scope thereof, and the scope thereof is determined by the claims that follow.

We claim:

1. A method for managing hydrates in a subsea production system, the system having at least one producing subsea well, a jumper for delivering produced fluids from the subsea well to a manifold, a single production line connected to a single production sled for delivering all of the produced fluids to a production gathering facility, and an umbilical for delivering chemicals to the manifold, the method comprising the steps of:

shutting in the flow of produced fluids from the at least one producing subsea well and through the single production sled and the single production line;

pumping a displacement fluid into the umbilical through a chemical injection tubing;

pumping the displacement fluid through the chemical injection tubing, through the manifold, and into the single production line through the single production sled; and pumping the displacement fluid through the manifold and into the single production sled directly to the single production line so as to displace the produced fluids before hydrate formation begins.

2. The method of managing hydrates of claim 1, wherein:

the chemical injection tubing is tied back to the gathering facility; and the umbilical comprises a first umbilical portion that connects the gathering facility with an umbilical termination assembly, and a second umbilical portion that connects the umbilical termination assembly with the manifold.

3. The method of managing hydrates of claim 1, wherein:

the chemical injection tubing is tied back to the gathering facility; and the method further comprises pumping a chemical inhibitor into the chemical injection tubing before pumping the displacement fluid into the chemical injection tubing.

4. The method of managing hydrates of claim 1, wherein:

the chemical injection tubing is tied back to the gathering facility; and the method further comprises pumping a chemical inhibitor having methanol into the chemical injection tubing before pumping the displacement fluid into the chemical injection tubing.

5. The method of managing hydrates of claim 1, wherein:

the displacement fluid contains dehydrated crude oil.

6. The method of managing hydrates of claim 1, wherein:

the displacement fluid contains diesel.

7. The method of managing hydrates of claim 1, wherein:

the single production line is insulated;

the chemical injection tubing is tied back to the gathering facility;

the produced fluids are substantially uninhibited prior to shutdown; and the method further comprises pumping a chemical inhibitor into the chemical injection tubing before pumping the displacement fluid into the chemical injection tubing and during the cool down period.

8. The method of managing hydrates of claim 1, wherein:

the method further comprises depressurizing the single production line before pumping the displacement fluid into the single production line.

9. The method of managing hydrates of claim 1, further comprising the step of:

placing a pig ahead of the displacement fluid to aid in the displacing of produced fluids in the single production line.

10. The method of managing hydrates of claim 1, wherein:

the chemical injection tubing is tied back to the gathering facility; and the method further comprises the steps of:

pumping a chemical inhibitor into the chemical injection tubing before pumping the displacement fluid into the chemical injection tubing; and placing a pig ahead of the displacement fluid to aid in the displacing of the chemical inhibitor and produced fluids in the single production line.

11. The method of managing hydrates of claim 1, wherein the gathering facility is a floating production, storage and offloading vessel.

12. The method of managing hydrates of claim 1, wherein the gathering facility is a ship-shaped gathering vessel.

13. The method of managing hydrates of claim 1, wherein the gathering facility is near shore.

14. The method of managing hydrates of claim 1, wherein the gathering facility is onshore.

15. The method of managing hydrates of claim 1, further comprising after pumping the displacement fluid through the single production line:

re-initiating the flow of produced fluids from the subsea well, through the single production line, and to the gathering facility.

16. The method of managing hydrates of claim 15, further comprising after re-initiating the flow of produced fluids from the subsea well:

transporting the produced fluids to shore.

17. A method for managing hydrates in a subsea production system, the system having at least one producing subsea well, a jumper for delivering produced fluids from the subsea well to a manifold, a single, insulated production line for delivering all of the produced fluids to a production gathering facility connected to a single production sled, and an umbilical for delivering chemicals to the manifold, the method comprising the steps of:

placing a volume of chemical inhibitor fluid into a chemical injection tubing within the umbilical, with the chemical injection tubing being tied back to the gathering facility, and the umbilical comprising a first umbilical portion that connects the gathering facility with an umbilical termination assembly, and a second umbilical portion that connects the umbilical termination assembly with the manifold;

shutting in the flow of produced fluids from the at least one producing subsea well and through the single production sled and the single production line;

pumping a displacement fluid into the chemical injection tubing in order to displace the volume of chemical inhibitor fluid from the chemical injection tubing, through the manifold and into the single production line, and thereby at least partially displacing produced fluids from the single production line through the single production sled;

further pumping the displacement fluid through the chemical injection tubing, through the manifold, and into the single production line through the single production sled in order to more fully displace the produced fluids from the single production line and the single production sled; and pumping the displacement fluid through the manifold and into the single production sled directly to the single production line so as to displace the produced fluids before hydrate formation begins.

18. The method of managing hydrates of claim 17, wherein:

the displacement fluid contains dehydrated crude oil.

19. The method of managing hydrates of claim 17, wherein:

the displacement fluid contains diesel.

20. The method of managing hydrates of claim 17, wherein the production fluid in the single production line is uninhibited.

21. The method of managing hydrates of claim 17, wherein the gathering facility is a floating production, storage and offloading vessel.

22. The method of managing hydrates of claim 17, wherein the gathering facility is a ship-shaped gathering vessel.

23. The method of managing hydrates of claim 17, wherein the gathering facility is near shore.

24. The method of managing hydrates of claim 17, wherein the gathering facility is onshore.

25. A method for producing subterranean hydrocarbon fluids while managing hydrates in a subsea production system, the system having at least one producing subsea well, a jumper for delivering produced fluids from the subsea well to a manifold, a single production line connected to a single production sled for delivering all of the produced fluids to a production gathering facility, and an umbilical for delivering chemicals to the manifold, the method comprising the steps of:

shutting in the flow of produced fluids from the at least one producing subsea well and through the single production sled and the single production line;

pumping a displacement fluid into the umbilical through a chemical injection tubing;

pumping the displacement fluid through the chemical injection tubing, through the manifold, and directly into the single production line through the single production sled;

pumping the displacement fluid through the single production sled directly into the single production line so as to displace the produced fluids before hydrate formation begins; and re-initiating the flow of produced fluids from the subsea well, through the single production sled directly to the single production line to the production gathering facility.

26. The method of producing subterranean hydrocarbon fluids of claim 25, further comprising after re-initiating the flow of produced fluids from the subsea well:

transporting the produced fluids to shore.

27. The method of producing subterranean hydrocarbon fluids of claim 25, wherein the umbilical further comprises a first umbilical portion that connects the gathering facility with an umbilical termination assembly, and a second umbilical portion that connects the umbilical termination assembly with the manifold.

28. A method for transporting hydrocarbons from an offshore production facility, the production facility receiving produced hydrocarbons from at least one subsea well, a single production line and single production sled associated with a subsea production system, comprising the steps of:

shutting in the flow of produced fluids from the at least one subsea well and the single production line;

pumping a displacement fluid from the production facility into a chemical injection tubing, the chemical injection tubing being within an umbilical;

further pumping the displacement fluid into the chemical injection tubing so that displacement fluid is urged through a subsea manifold, through the single production sled, and into the single production line;

further pumping the displacement fluid through the single production sled and single production line so as to displace the produced fluids before hydrate formation begins;

re-initiating the flow of produced fluids from the at least one subsea well, through the single production line to the production facility; and transporting the produced fluids from the offshore production facility.

29. The method for transporting hydrocarbons of claim 28, wherein the step of transporting the produced fluids from the offshore production facility comprises:

offloading the produced fluids from the offshore production facility onto a tanker; and transporting the produced fluids to an onshore terminal.

30. The method for transporting hydrocarbons of claim 28, wherein the umbilical further comprises a first umbilical portion that connects the gathering facility with an umbilical termination assembly, and a second umbilical portion that connects the umbilical termination assembly with the manifold.

31. The method for transporting hydrocarbons of claim 30, wherein:

the subsea production system further comprises a jumper for delivering produced fluids from the subsea well to a manifold, and a valve for selectively placing the chemical injection tubing in fluid communication with the manifold; and the single production line comprises a production riser in fluid communication with the production facility, and a flowline for placing the manifold in fluid communication with the production riser.

* * * * *